US006304230B1

(12) United States Patent
Panther et al.

(10) Patent No.: US 6,304,230 B1
(45) Date of Patent: Oct. 16, 2001

(54) MULTIPLE COUPLED RESONANT LOOP ANTENNA

(75) Inventors: Gyles Panther, Stittsville; James S. Wight, Ottawa, both of (CA)

(73) Assignee: Sigem, Kanata (CA)

( * ) Notice: Subject to any disclaimer, the term of this patent is extended or adjusted under 35 U.S.C. 154(b) by 0 days.

(21) Appl. No.: 09/433,569

(22) Filed: Nov. 4, 1999

(51) Int. Cl.[7] ..... H01Q 21/00
(52) U.S. Cl. ..... 343/867; 343/742; 343/744
(58) Field of Search ..... 343/867, 742, 343/744, 870, 866, 741, 853; H01Q 21/00

(56) References Cited

U.S. PATENT DOCUMENTS 2,405,123 * 8/1946 Fyler ..... 343/867
4,518,965 * 5/1985 Hidaka ..... 343/744
5,402,134 * 3/1995 Miller et al. ..... 343/742
5,625,371 * 4/1997 Miller et al. ..... 343/867
6,016,129 * 1/2000 Lauper ..... 343/867
6,025,813 * 2/2000 Hately et al. ..... 343/744

* cited by examiner

*Primary Examiner*—Hoanganh Le
(74) *Attorney, Agent, or Firm*—Harold C. Baker; Robert A. Wilkes; Robert G. Hendry

(57) ABSTRACT

A loop antenna which is electrically small relative to a wavelength of a signal which it is designed to receive. The antenna is an electrically small, low profile, band switchable antenna which can be mounted on a metallic surface such as a truck or railway car rooftop and can be used to communicate with earth satellites. The antenna is polarized such that the plane containing the electric field is horizontal. Alternatively, the antenna can receive circularly polarized signals.

14 Claims, 6 Drawing Sheets

MULTIPLE COUPLED RESONANT LOOP ANTENNA

FIELD OF THE INVENTION

This invention relates to the field of antennas and in particular to a loop antenna which is electrically small relative to a wavelength of a signal which it is designed to receive or transmit.

BACKGROUND TO THE INVENTION

There is a need for an electrically small, low profile, band switchable VHF antenna which can be mounted on a metallic surface such as a truck or railway car rooftop. Such antennas could be used to communicate with earth satellites, and therefore preferably should be polarized such that the plane containing the electric field is horizontal in normal use. It would also be useful to have the antennas design such that it could receive circularly polarized signals.

Antennas which are used today typically have elements of the order of ¼ wavelength in length, such as whip antennas. However, such antennas are not low profile, as they must be mounted with their axes perpendicular to a conductive ground plane. Dipoles have balanced elements each ¼ wavelength long, but cannot be low profile above and in close proximity to a conductive plane.

The small loop antenna is a well known structure, and many forms have been devised as shown in FIGS. 1A, 1B and 1C. For example, in FIG. 1A the equivalent circuit of a multi-turn loop antenna 1 is shown. An incident electromagnetic (EM) wave induces a small voltage which is shown as equivalent to a voltage generator 3 in series with the loop 1. Small equivalent series resistances 5 and 7 represent radiated energy from the antenna and ohmic losses due to parasitic resistances respectively. The loop itself exhibits inductance. At VHF frequencies and below, ferromagnetic materials may be included in the core of the loop (not shown) to increase the radiation resistance (and hence the efficiency) of the antenna.

In general, the impedance of the antenna at the loop terminals is undesirably highly reactive resulting from the series of a very small resistance value and a high value inductance. The inductive loop can be resonated with a capacitor 9, but this results in an equally undesirable very high output impedance.

The impedance can be transformed to a lower value by the use of a capacitive tap configuration as shown in FIG. 1B, wherein the capacitor 9 is split into two series capacitors 9A and 9B, with the output signal being taken across one of the capacitors. Alternatively, the impedance can be transformed to a lower value by use of an inductively coupled loop 11, as shown in FIG. 1C.

Antenna performance is characterized by antenna efficiency Ea, which is given by $$Ea=10*\log(Rr/(Rr+Ro))$$

Where Rr is the useful radiation resistance and Ro is the equivalent resistance representing the sum of all ohmic losses.

Electrically small loops have very small values of radiation resistance. For example, a loop of approximately 10 square inches in areEt (e.g. as may be formed by a 1.75" radius circle, or by a rectangular shape of equal area) has a radiation resistance of approximately 0.08 ohms in free space at 150 MHz. However, such a loop also has a considerable parasitic resistance arising from the well known skin effect and the equivalent series resistance (ESR) of capacitors used to transform the output impedance.

The skin effect limits the flow of radio frequency (RF) currents to a surface Layer in a conductor. For example, in a copper conductor at 150 MHz, the RF current is diminished to 1/e of its surface value in 5.4 microns, resulting in a resistance of 3.2 mohms per square of conducting surface. As a result, large diameter wire or wide metal strip conductors are necessary to minimize ohmic losses. For example, as shown in FIG. 2, a circular cross section antenna 13 fabricated from a 0.25 inch wide copper strip, 2.5 inches in diameter has a metallic resistance of 0.08 ohms, which is the same as its radiation resistance.

Capacitor parasitic series resistances amount to approximately 80 mohms per capacitor (which can be mitigated by use of multiple capacitors in parallel).

Such a loop antenna with two tuning capacitors in parallel (ESR =0.04) thus has total parasitic resistance of 0.12 ohms and a radiation resistance of 0.08 ohms, and thus an efficiency of −4dB.

The inductance of such a loop is approximately 80 $\mu$H, so that the loaded Q of the antenna is 190 at 150 MHz, resulting in a 3 dB bandwidth at 0.79 MHz. This is very narrow, but the useable bandwidth is considerably smaller yet, because in fact only a 1 dB degradation can be typically accommodated.

As is known, a repelling force is exerted on parallel flowing currents. The effect of this is to cause the current flowing in the circular cross section strip shown in FIG. 2 to tend to flow at the edges of the strip and to be attenuated in the center. If the current were uniform, the highest magnetic flux density would occur in the center of the strip. Currents flowing in this strip would require greater energy than at the edges, and consequently the current becomes non-uniform, thereby defeating the lower resistance strategy.

Also, the wide spatial distribution of the current results in diminished mutual coupling between parallel current components in the same conductor, which results in a lower inductance. The far field generated by currents in a loop is the superposition of the contributions of the incremental currents within it. If the loop current is concentrated toward the edges of the strip as a result of strip width, the center portion will not contribute significantly, and the antenna will behave as two loosely coupled loops, switch concomitantly poor performance.

The radiation resistance of a multi-turn antenna increases as the square of n, the number of turns. Since the skin effect losses increase proportionally to the wire length used in the antenna, the efficiency of a multi-turn loop antenna is improved over a single turn loop antenna.

However, the inductance of the loop antenna also increases as the square of the number of turns, and at 150 MHz, the requirement for a large antenna coil area results in impracticably high inductance values. For example, two fully coupled turns of the dimensions above would have an inductance value of 320 nH, and require a very small value tuning capacitor. This becomes impractical for many reasons, including susceptibility to de-tuning by environmental stray capacitance.

It may be seen that conventional loop antennas provide a very narrow band response and in general are inefficient.

SUMMARY OF THE INVENTION

The present invention is a loop antenna which is electrically small relative to a wavelength of a signal which it is designed to receive . An embodiment of the invention provided electrically small, low profile, band switchable antenna which can be mounted on a metallic surface such as a truck or railway car rooftop, and thus could be used to communicate with earth satellites. In this embodiment of the invention, it is polarized such that the plane containing the electric field is horizontal. Another embodiment is designed such that it can receive circularly polarized signals.

In accordance with an embodiment of the invention, a loop antenna is comprised of a plurality of mutually coupled loops, each loop being coupled to a capacitive structure so as to form a resonant tank, and including a circuit for receiving or applying a signal therefrom or thereto.

In accordance with another embodiment of the invention, the loops of the loop antenna have part rectangular configuration, the loops being contained in respective planes which are parallel to each other and are orthogonal to a ground plane, one end of each of the loops being connected to the ground plane, a capacitor connecting the other end of each respective loop to the ground plane.

In accordance with another embodiment, a loop antenna comprises a loop connected in series with a capacitor to form a resonant tank, and a further loop formed of two loop parts, first adjacent ends of the loop parts being connected together via a switch circuit, other adjacent ends the loop parts being connected together via a capacitor, arid a circuit for controlling the switch circuit to connect or disconnect the first adjacent ends of the loop parts together, the loop parts being coupled to at least one of the mutually coupled loops.

BRIEF INTRODUCTION TO THE DRAWINGS

A better understanding of the invention may be obtained by reading the detailed description of the invention below, in conjunction with the following drawings, in which:

FIG. 8 is a partly physical and partly schematic view of a feed structure for the embodiment of

Figure 9:
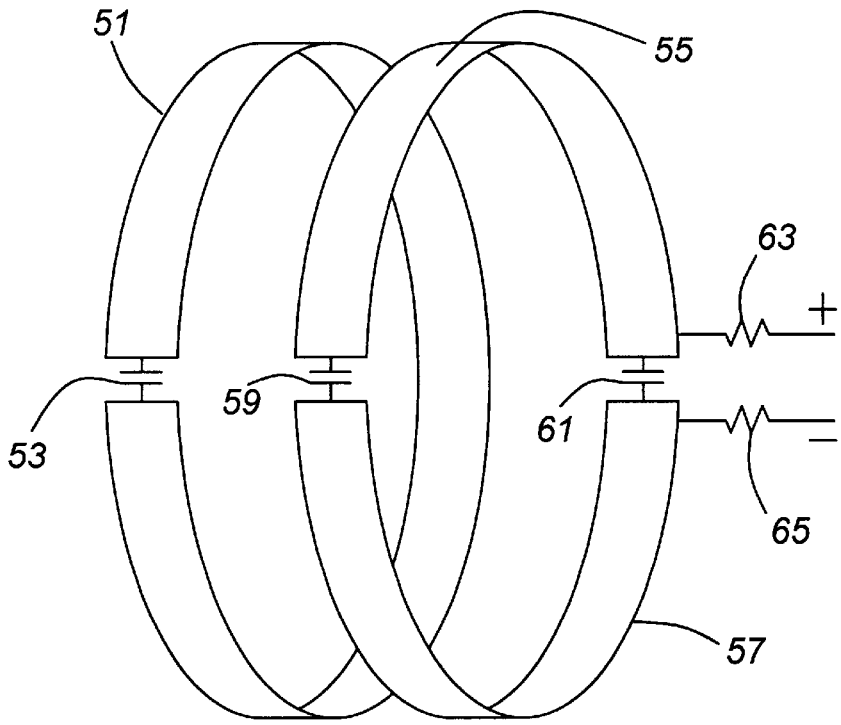
Figure 10:
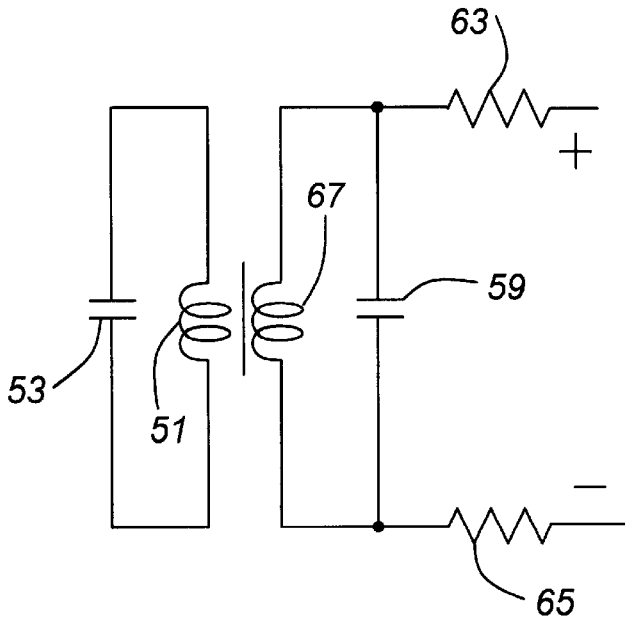
Figure 11:
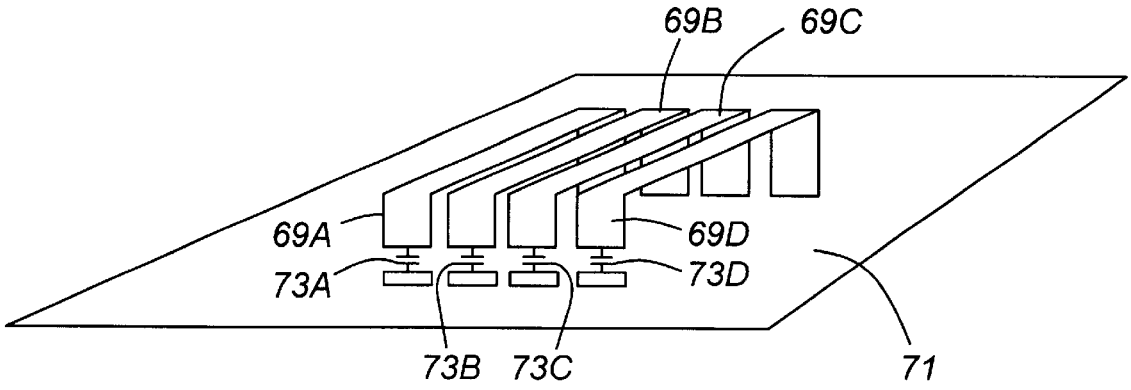
Figure 12:
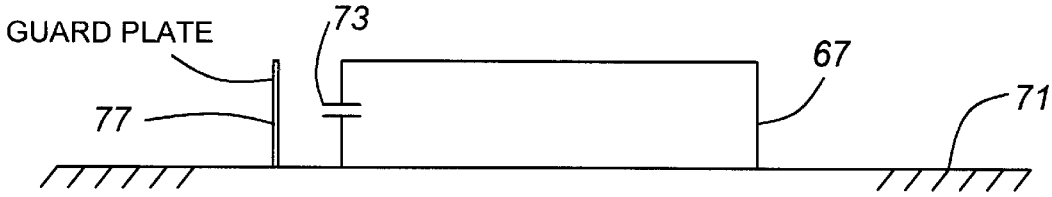
Figure 13:
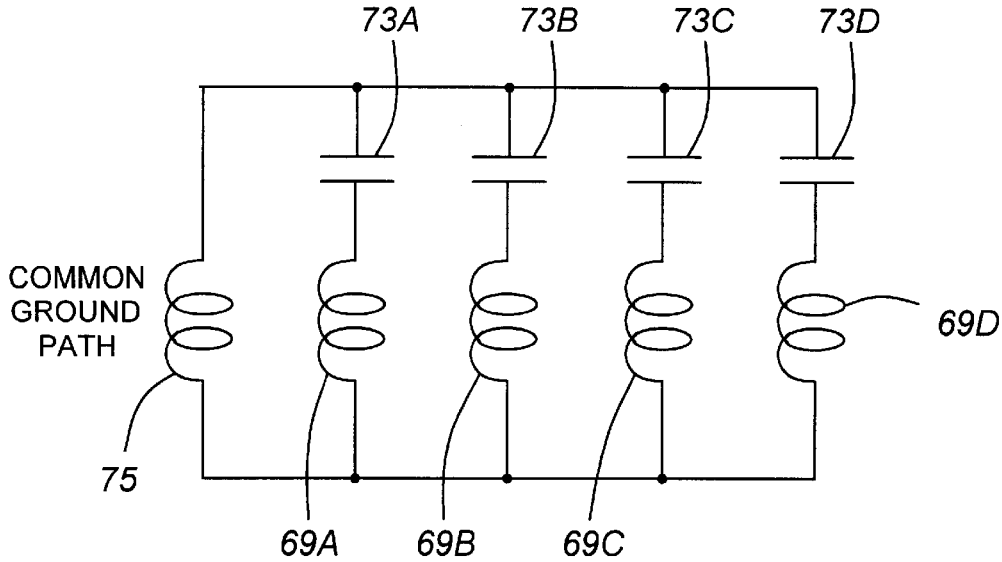

FIG. 7,

FIG. 9 is a partly isometric and partly schematic view of another embodiment of the invention, FIG. 10 is an equivalent circuit of the embodiment of FIG. 9, FIG. 11 is a partly isometric and partly schematic view of another embodiment of the invention, FIG. 12 is an end view of the embodiment of FIG. 11, and FIG. 13 is an equivalent circuit of the embodiment of FIG. 11.

DETAILED DESCRIPTION OF EMBODIMENTS OF THE INVENTION

The present invention is comprised of a predetermined number n co-linear wire or metal strip loops, each tuned with a capacitor. The individual loops are tightly coupled e.g. through mutual inductance.

Figure 1A:
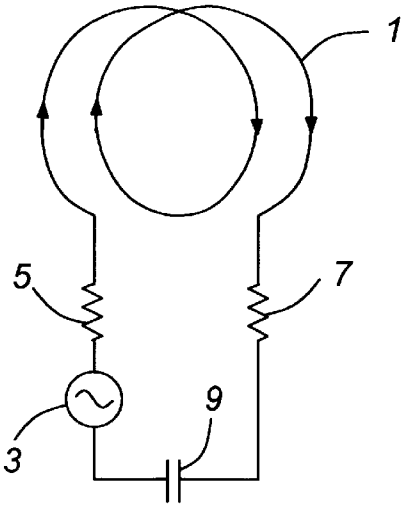
PRIOR ART FIG. 1A
FIGS. 1A, 1B and 1C illustrate equivalent circuits of loop antennas in accordance with the prior art.
Figure 1B:
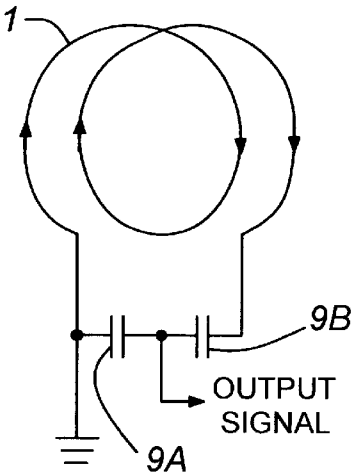
PRIOR ART FIG. 1B
Figure 1C:
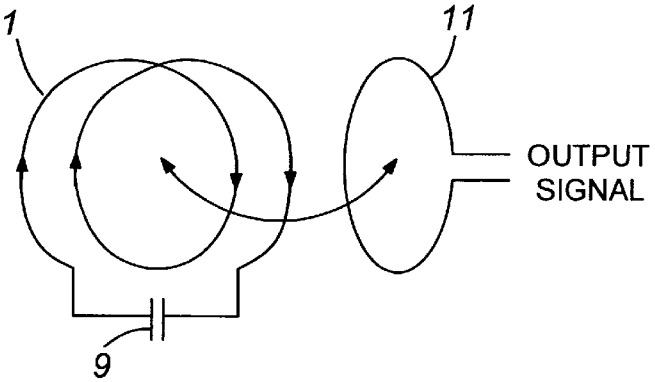
PRIOR ART FIG. 1C
Figure 3:
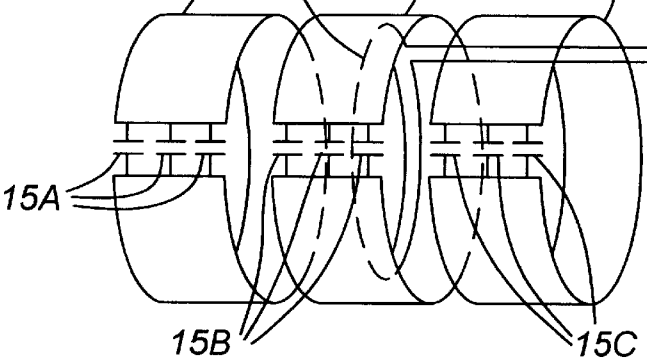
FIG. 3 illustrates an embodiment of the present invention.
Figure 2:
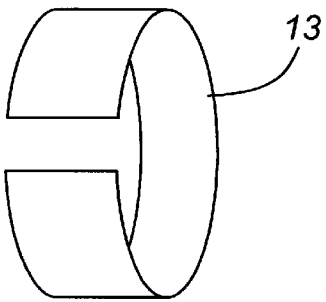
FIG. 2 illustrates an undesirable form of wide conductor loop antenna.

In a preferred embodiment, as, shown in FIG. 3, loops 13A, 13B and 13C are constructed of copper strip in a circular (as shown, each similar to strip 13 of FIG. 2) or elliptical or rectangular cross sectional form. An output feed is taken from an additional loop 17 which is loosely coupled to the tightly coupled group of loops 13A–13C. The coupling is arranged so as to provide a matched feed to a transceiver element (not shown) to which the output of the loosely coupled loop 17 is coupled. At least one, but preferably more than one capacitor 15A, 15B and 15C is coupled to ends of the respective loops 13A, 13B and 13C.

Each loop, and group of capacitors or single capacitor sets, form a resonator (or tank), the resonant frequency of which can be changed by varying the capacitance of the associated capacitor or group of capacitors.

The mutually coupled loops can be maintained in free space, or close to a ground plane as will be described later.

Figures 4A, 4B, 4C:
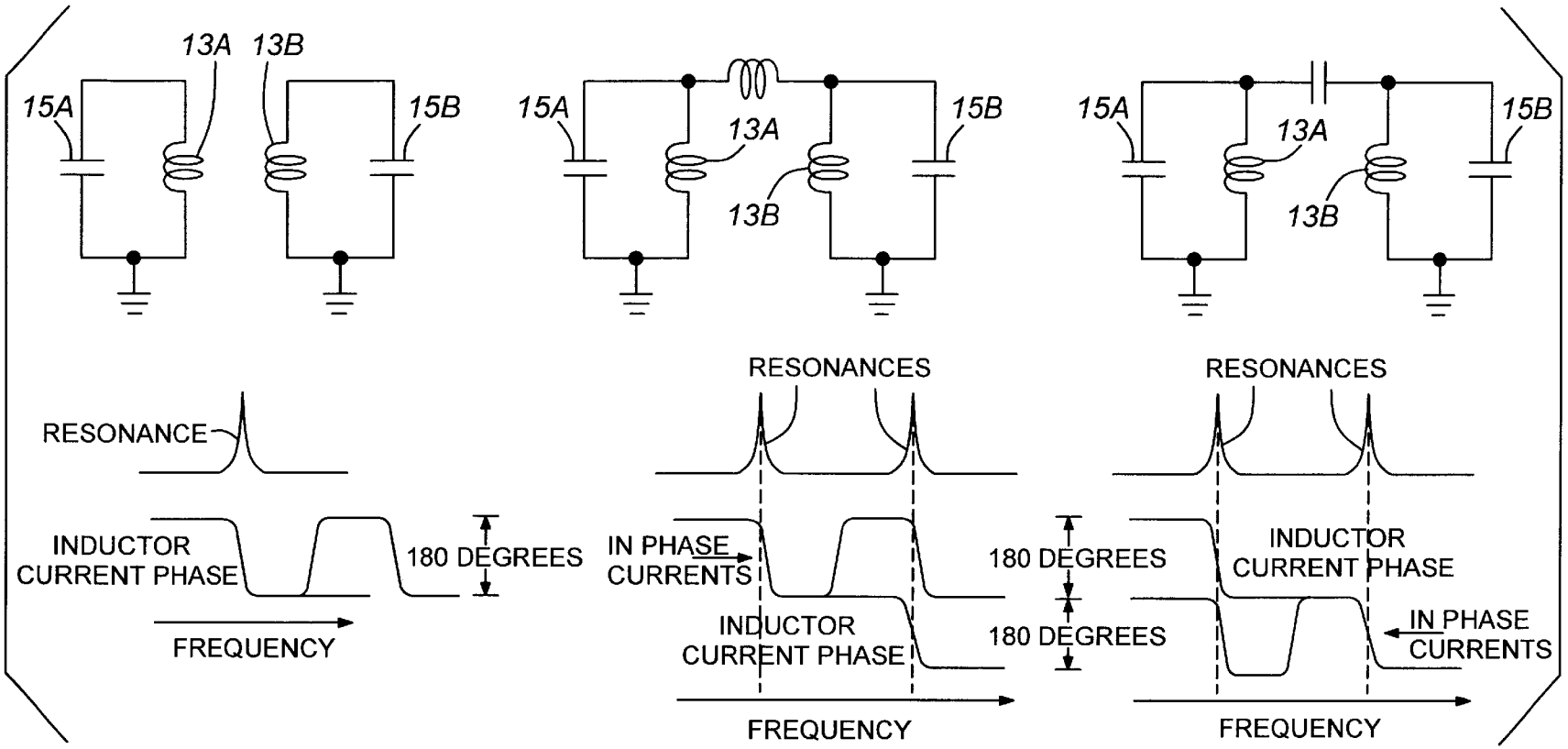
FIGS. 4A, 4B and 4C are schematic diagrams of three embodiments of the invention, including current phase and resonance diagrams.

In order to understand the above described embodiment, reference is now made to FIGS. 4A, 4B and 4C, which show three pair of identical resonant tanks in which the inductors 13A, 13B represent a pair of corresponding antenna loops of FIG. 3 and in which capacitors 15A and 15B represent the corresponding capacitors in FIG. 3. FIG. 4A shows the tanks uncoupled, FIG. 4B shows the tanks inductively coupled, and FIG. 4C shows capacitive coupling of the tanks. Of course, more than the three loops shown can be used.

In FIG. 4A, both tanks are assumed to have an identical resonance frequency. If coupling is introduced between the tanks as shown in FIGS. 4B and 4C, the single resonance becomes split into two; the frequency difference between them being a function of the coupling.

With reference to the current phase diagrams immediately below the circuits, it will be seen that in the case of inductive coupling, the inductor currents of the low frequency resonance are in phase. With capacitive coupling the inductor currents are in phase at the upper frequency. Mutual inductive coupling between the tanks is the circuit equivalent of inductive coupling. The current phases shown are relative to that of an arbitrary drive signal.

It has thus been shown that resonant circuits which are in close proximity, such as adjacent collinear loops, will couple magnetically and will behave as if coupled with an inductor between them as shown in FIG. 4B. At the lower resonant frequency, all of the loop currents are in phase, and the overall structure behaves similarly to a multi-turn antenna, bit with reduced inductance.

With respect to FIG. 4B, for two tightly coupled inductors (e.g. k=.99), the effect on individual inductors is as if each value were doubled. In general, for n mutually coupled inductors, it can be shown that the effect of the coupling is to increase the value of each by n at the lower of the two resonant frequencies. Thus more convenient (easier to achieve and use) values of tuning capacitor an be used because of the lower inductor values of the present invention as compared with the multi-turn loop for which the inductance is proportional to $n^2$.

An EM wave incident on a metallic (conductive) surface undergoes a reflection, analogous to light reflected from a mirror. The EM wave has magnetic and electric fields in spatial quadrature to the direction of propagation. On reflection at the conductive surface, the electric field is inverted in phase so that at the surface, cancellation of the incident and reflective electric wave occurs, dependant on the reflection coefficient. However, the reflected magnetic field component is in phase, so that the magnetic field at the surface is increased by up to two, relative to free space values.

Thus the EM wave induces a voltage in each loop of the antenna. The voltage in a particular loop is the sum of that induced by an incident EM wave and the voltages induced by the currents in the adjacent loops. Since both the inductance and the induced voltages are proportional to the number of coupled loops, the current in each loop has the same phase and is equal in magnitude to that which would be genrated if the other loops were not present.

It has also been determined that the current distribution in the antenna of the present invention is more uniform. Since the currents in the adjacent windings of the antenna exert a repelling force on each other, the tendency for current to flow at the conductor edges is, to a degree, counteracted.

The far field power flux power density, P, of a single turn of a square loop antenna is proportional to $$P \alpha (\pi/\lambda)^4 (I \cdot A/r)^2$$

Where A is the loop area, $\lambda$ is the free space wavelength, r is the distance from the antenna, and I is the RMS current in the loop.

For the case of either a multi-turn loop, or a structure in which each loop of the present invention in which there are multiple resonant loops (MCRL) carrying equal currents, the far field is the superposition sum of the contributions due to each turn. Since the power density is proportional to the square of the magnitude of the electric and magnetic fields, the radiation resistance is, in both cases, proportional to the square of the number of turns.

With the present MCRL structure, the loop inductance increases proportionally with the number of elements (turns) while the radiation resistance increases as the square of the number of turns. Thus the Q of an antenna in the form of the present invention decreases with an increased number of turns, with a concomitant increase in bandwidth.

At VHF frequencies, the wire diameter or metal strip width of the loops results in diminished coupling between windings, thus limiting the extent to which coils may be coupled in either configuration. However, the MCRL structure can utilize many more loops than can be practically achieved for the multi-turn antenna, and thus the MCRL structure offers considerable practical advantages relative to a small multi-turn loop antenna.

Individual adjacent loops in an MCRL antenna are tightly coupled by mutual inductance and consequently the tuning of each loop alters the tuning of those loops to which it is coupled. Theses in turn alter the tuning of other coupled loops, so that variation of a tuning capacitor in a single loop changes the resonant frequency of the entire structure.

Two benefits result from the above. Firstly, the MCRL antenna can be trimmed to frequency with a single capacitor, and secondly, the structure is particularly amenable to electronic switching.

Figure 5:
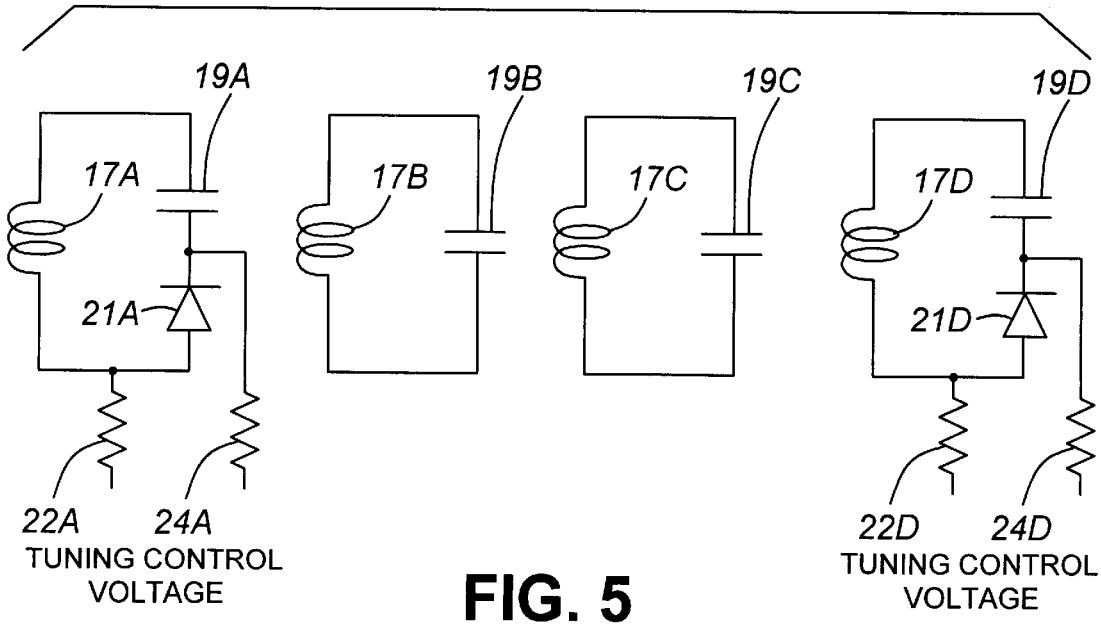
FIGS. 5 and 6 are schematic diagrams of two additional embodiments of the invention.

Electronic switching can be achieved by the use of varactor diodes in place of one or more tuning capacitors, as shown in FIG. 5. Loops 17A–17D are coupled to capacitors 19A–19D respectively, to form tank circuits. Varactor diode 21A is connected in series with capacitor 19A and loop 17A, and varactor diode 21D is connected in series with capacitor 19D and loop 17D. The capacitance of varactor diode 21A is thus combined with that of capacitor 19D to form a capacitance $1/(C_{19A}+C_{21A})$ and capacitance of varactor diode 21D is thus combined with that of capacitor 19D to form a capacitance $1/(C_{19D}+C_{21}D)$ . The resonance of the tank with loop 17A is determined by the inductance of loop 17A with the associated combined capacitance, and the resonance of the tank with the loop 17D is determined by the inductance of the loop 17D with the associated combined capacitance, as further influenced by the resonance of the remaining coupled loops.

A control voltage is applied across varactor diode 21A via resistors 23A and 25A to control its capacitance, and a control voltage is applied across varactor diode 21D to control its capacitance. Thus by controlling the values of the control voltages, the resonance of the tank circuits and thus the resonant frequency of the entire antenna can be controlled.

While the embodiment of FIG. 5 has varactor diodes in two tank circuits, other tuning configurations can be devised by persons skilled in the art, such as which use only a single varactor diode in only one tank circuit, or several varactor diodes in one or plural tank circuits to provide continuous tuning over a predetermined frequency band.

Figure 6:
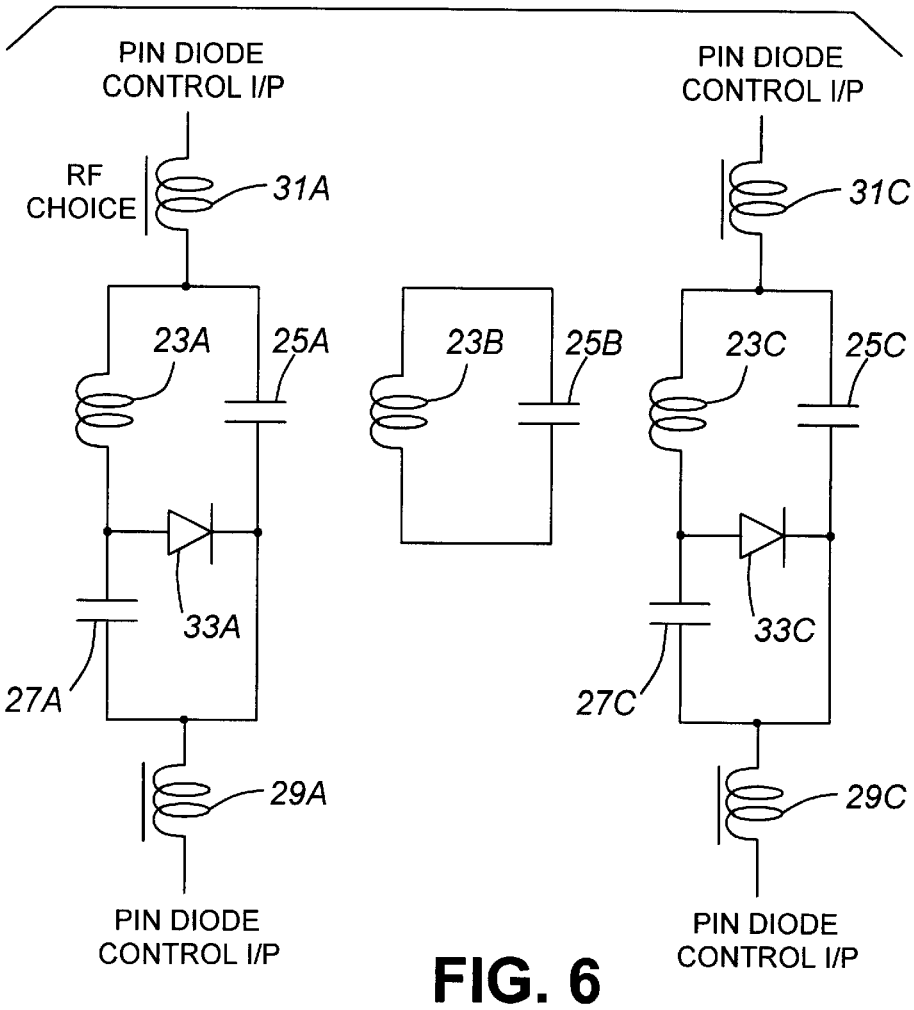

FIG. 6 illustrates the MCRL structure using PIN diodes to switch tuning capacitors in and out of one or more tank circuits, and thus provide discrete frequency change increments. PIN diode control is particularly suitable for frequency switching between receive and high power transmit operational modes.

A loop 23A of an MCRL structure is coupled to tuning capacitor 25A in a tank circuit. An auxiliary tuning capacitor 27A is connected in series with the loop 23A; both capacitors are connected together to one terminal of an RF choke 29A. Another RF choke 31A is connected to a junction of capacitor 25A and loop 23A. A PIN diode 33A is connected in parallel with capacitor 27A.

A control voltage is applied to the other terminals of the chokes 29A and 31A, which is sufficient to cause the PIN diode 33A to conduct. Once the diode is conducting, it short circuits capacitor 27A. Since the resonant frequency of the tank circuit is dependent on the capacitance of both capacitors 25A and 27A by $1/(C_{25A}+C_{27A})$, switching in or out of capacitor 27A controls the resonant frequency of the tank.

A tank which contains loop 23C is similarly structured, with capacitors 25C and 27C, PIN diode 33C, and RF chokes 29C and 31C. With control voltage applied to the PIN diode 31C through the RF chokes, capacitor 27C is bypassed, changing the resonant frequency of the tank, and thus of the antenna.

A representative third tank comprised of loop 23B and capacitor 25B in this example does not have a second switched capacitor in the tank The purpose of the chokes is to block oscillating current in the tank from leaking away from the tank, e.g. to the control voltage source. In the event that other measures are taken to stop the leakage, or that the chokes are not needed due to the nature of the control voltage source, the chokes can be deleted. In the event that the varactor control voltages of the embodiment of FIG. 5 are provided by circuits that do not require the resistors 22A, 24A and 22D and 24D, they may be dispensed with. On the other hand, chokes may have to be connected in the control voltage supply conductors to the varactor so as to block leakage of oscillating current from the tank.

It has been determined that small loop antennas behave as elliptically polarized radiators (and by reciprocity, receivers) and for electrically small structures, as in the present invention, become so elliptical that they can be considered as being linear. Thus two MCRL antenna structures can be made into a circular polarized structure from the,e effective linear elements by arranging them in an orthogonal structure which is fed in quadrature, as shown in FIG. 7.

Figure 7:
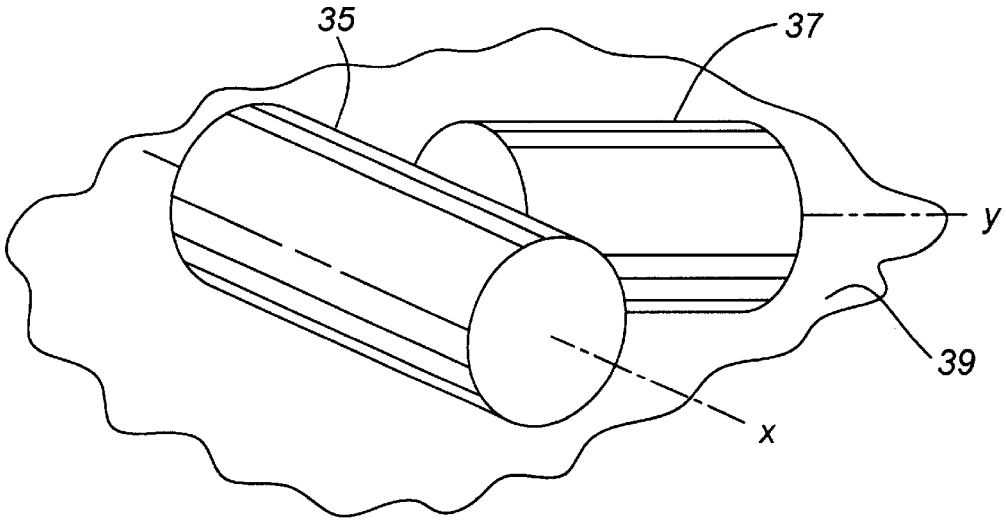
FIG. 7 is a mechanical view of another embodiment of the invention.

In FIG. 7, a pair of MCRL structures 35 and 37 each as described above is disposed with the axis X of one orthogonal to the axis Y of the other. A plane containing the two axes is parallel to a conductive ground plane 39. Each MCRL structure contains a loosely coupled loop as described with reference to FIG. 3 for receiving (or for applying) a signal which has been received or is to be transmitted by the antenna.

Figure 8:
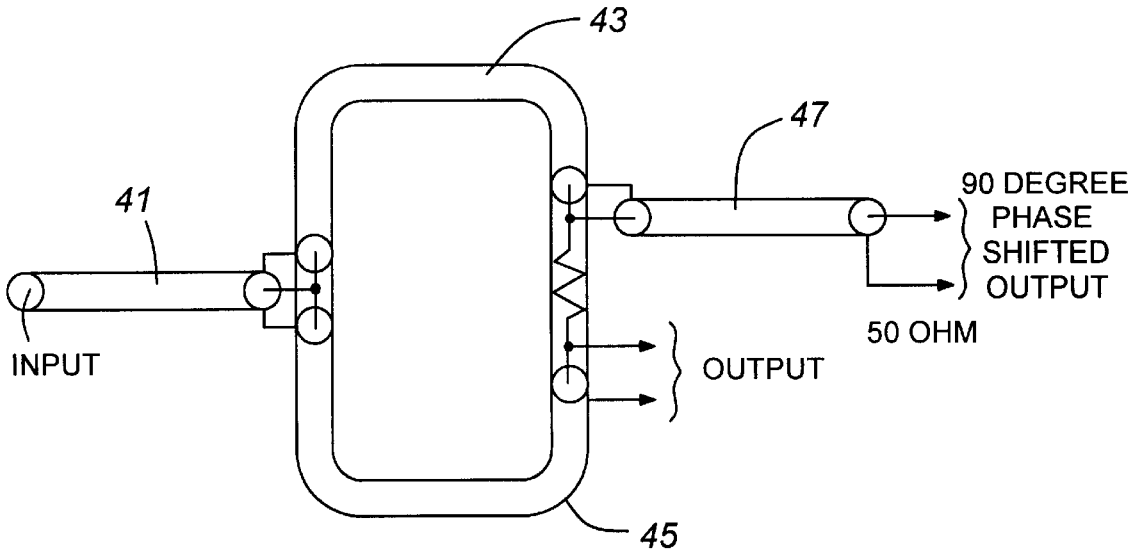

The loosely coupled loops are connected to a quadrature feeding network, a preferred embodiment of which is shown in FIG. 8. The network is comprised of an isolating combiner with a phase shifter in one branch of the two outputs.

As a feeder network, an input signal is received by a coaxial cable 41, e.g. of 50 ohm;. The cable 41 is connected to a pair of lengths 43 and 45 of coaxial cable, each ¼ wavelength in length. The impedance of the pair 43 and 45 should be 1.414 times the impedance of the input coaxial cable 41, i.e. in this example 70.7 ohms. One of the pair of lengths, e.g. 43, is connected directly to one end of an output coaxial cable 47 which should have the same impedance as the input coaxial cable, e.g. 50 ohms. The center conductor of the other of the pair of lengths, e.g. 45, is connected to the end of the other of the lengths 43 by a resistance which is double the resistance of the impedance of the output coaxial cable 47.

The other end of output cable( 47 feeds the input signal to cable 41, 90 degrees phase shifted, to one of the loosely coupled loops in MCRL structure 35 or 37. The end of the other of the lengths 45 feeds the input signal, in phase, to the other of the loosely coupled loops in the other MCRL structure 37 or 35.

Thus the radiated signal from the combined antenna structure of FIG. 7 is circularly polarized. By reciprocity, circularly polarized ,signals received by the combined antenna structure appears at the end of coaxial cable 41 previously described as an input end.

It can be shown that the radiation gain pattern of the MCRL structure in free space is, similar to that of a dipole with nulls on the axis of the loops. For a conventional half wave dipole, the peak gain is 1.7 (2.2 dB) because radiation is enhanced in a doughnut pattern, and is suppressed along the axis of the dipole. The gain of the MCRL may be less than a dipole because the small size of the antenna will result in less well defined nulls, and consequently somewhat lower peak gain.

When mounted in close proximity above a large conductive plane, the radiation pattern of the MCRL will be increased by approximately 3 dB in the direction above the conductive plane, and normal to it. This increased gain arises because radiation is suppressed in the direction behind the conductive plane. Thus the peak gain is at zenith with the conductive plane horizontal.

FIG. 9 is an isometric view and schematic illustrating an alternative method of tuning the antenna. A tuned tank of the antenna as described earlier comprising a loop 51 and a capacitor 53 is shown, coupled to another loop formed of a loop formed of parts 55 and 57 connected at adjacent ends to terminals of a PIN diode 59. The other adjacent ends are connected to terminals of a DC blocking capacitor 61.

A control signal is applied from the terminals marked +and−via resistors 63 and 65 to the respective parts 55 and 57, so as to be conducted to PIN diode 59, and switch PIN diode 59 into or out of conduction.

When the PIN diode is switched into conduction, the parts 55 and 59 form a shorted turn, which is coupled into the tank formed of loop 51 and capacitor 53. The inductance of the tank is thus reduced by the opposing current flowing in the shorted turn, and the resonant frequency thus increases.

FIG. 10 is an equivalent circuit of the embodiment of FIG. 9. The loop 51 of the tuned tank has a switched shorting turn 67 formed of parts 55 and 57 coupled to it. Shorting of turn 67 is effected by switching PIN diode 59 into conduction by switch current applied to the + and − leads and carried via resistors 63 and 65.

Another embodiment of the invention is illustrated in FIG. 11.

In this embodiment, the loops 69A–69D are formed as parts of rectangles. Series capacitors 73A–73D connect one of the ends of the respective loops to the ground plane 71, while the other ends of the respective loops are connected directly to the ground plane. An end view of a loop 67 with tuning capacitor 69 connected to ground plane 71 is shown in FIG. 12. As a result, each loop with its respective tuning capacitor forms a resonant loop (tank).

FIG. 13 illustrates the equivalent circuit of the structure of FIG. 11. Each tank formed of a respective resonant loop 67A–67D and associated capacitor 73A–73D is in parallel, the common ground plane forming an equivalent inductor 75 connected between the respective places where the inductors and capacitors are connected to ground.

Each of the capacitors may be plural capacitors, some of which may be switched into or out of its respective tank as described earlier.

In order to help reduce detuning due to "hand effects", a guard conductive plate 77 can be located opposite the capacitors 73A–73D as shown in FIG. 12. The guard plate 77 can be fixed at right angles to, and connected to the ground plane 71 adjacent the connections between the capacitors and the loops. The stabilizing plate 77 is placed so as to provide a termination for the lines of force emanating from the loops at the points at which they are connected to the capacitors, which are the points of maximum voltage excursion.

The latter embodiment is particularly useful in the case that a low profile loop antenna is to be used above a vehicle roof for communication with an earth satellites, where low profile and some immunity from hand effects that can be caused by close proximity of personnel to the antenna outside the cab of the vehicle is desirable.

A person understanding the above-described invention may now conceive of alternative designs, using the principles described herein. All such designs which fall within the scope of the claims appended hereto are considered to be part of the present invention.

We claim:

1. A loop antenna comprising a plurality of mutually coupled loops arranged colinearly, each loop being formed of a copper strip, and including a capacitive structure so as to form a resonant tank, a further loop coupled to said mutually coupled loops, to provide a matched feed to an external circuit for inputting or receiving a signal to or from the antenna, in which the mutually coupled loops are tightly coupled through mutual inductance, in which the capacitive structure of at least one loop is variable.

2. The loop antenna as defined in claim 1 in which the variable capacitor is comprised of a varactor diode, and further including a circuit for applying variable voltage across the varactor diode for controlling the capacitance thereof.

3. The loop antenna as defined in claim 1 in which the variable capacitor is comprised of selectable fixed capacitors, and further including a circuit for switching at least one fixed capacitor into or out of a resonant circuit with said at least one loop.

4. The loop antenna as defined in claim 3 in which the circuit for switching is comprised of at least one PIN diode, and further including at least one circuit for selectively applying at least one voltage across the at least one PIN diode.

5. A loop antenna comprising a plurality of mutually coupled loops arranged colinearly, each loop being formed of a copper strip, and including a capacitive structure so as to form a resonant tank, a further loop coupled to said mutually coupled loops, to provide a matched feed to an external circuit for inputting or receiving a signal to or from the antenna, in which the mutually coupled loops are tightly coupled through mutual inductance, in which a first predetermined number of mutually coupled loops arranged colinearly, and a second number of mutually coupled loops comprising tanks arranged colinearly along an axis which is orthogonal to an axis of the first predetermined number of mutually coupled resonant loops, an network coupled to each of said numbers of mutually coupled resonant loops so as to feed the respective first and second numbers of mutually coupled resonant loops in quadrature, the network being comprised of an isolating combiner for splitting an input signal into two similar signals, and a 90° phase shifter for receiving one of said two similar signals and phase shifting it by 90°, and a circuit for feeding a second of said two similar signals and the 90° phase shifted one signal to respective ones of the orthogonally disposed first and second predetermined number of mutually resonant loops, in which the isolating combiner is comprised of a pair of lengths of coaxial cable each nominally ¼ wavelength of a signal to be carried thereby in length, both lengths of coaxial cable being connected at one end to an input coaxial cable for carrying an input signal to the pair of lengths of coaxial cable, a first output coaxial cable nominally ¼ wavelength in length having one end connected to another end of the one coaxial cable of the pair of lengths and having similar impedance as the input coaxial cable, another end of the other coaxial cable of the pair of lengths of coaxial cable providing a second output, the impedance of each coaxial cable of the pair of lengths of coaxial cable having an impedance which is nominally 1.414 times the impedance of the input coaxial cable, and a resistance structure connecting said another ends of the pair of lengths of coaxial cable which is double the impedance of the first output coaxial cable, and a circuit for coupling the second output and a second end of the first output coaxial cable to a respective loop of the respective orthogonal numbers of mutually coupled resonant loops.

6. A loop antenna as defined in claim 5 in which the mutually coupled loops are disposed in close proximity above a conductive plane.

7. A loop antenna as defined in claim 6 in which said proximity and the dimensions of the conductive plane are such that electromagnetic energy reflected from the conductive plane is added to electromagnetic energy otherwise induced in the mutually coupled loops, and that electric field energy incident on the conductive plane is substantially cancelled at the conductive plane.

8. A loop antenna as defined in claim 6 in which the conductive plane is in sufficiently close proximity to the mutually coupled loops and of such dimensions as to form a ground plane.

9. A loop antenna as defined in claim 5 in which the loops have part rectangular configuration, the loops being contained in respective planes which are parallel to each other and are orthogonal to a ground plane, one end of each of the loops being connected to the ground plane, a capacitor connecting the other end of each respective loop to the ground plane.

10. A loop antenna as defined in claim 9, further including a stabilizing plate which is in a plane orthogonal to both the ground plane and to the rectangular loops, the stabilizing plate being connected to the ground plane, and is disposed adjacent connection points of the loops and corresponding capacitors of respective resonant tanks.

11. A loop antenna comprising a plurality of mutually coupled loops arranged colinearly, each loop being formed of a copper strip, and including a capacitive structure so as to form a resonant tank, a further loop coupled to said mutually coupled loops, to provide a matched feed to an external circuit for inputting or receiving a signal to or from the antenna, in which the mutually coupled loops are tightly coupled through mutual inductance, including a further loop formed of two loop parts, first adjacent ends of the loop parts being connected together via a switch circuit, other adjacent ends the loop parts being connected together via a capacitor, and a circuit for controlling the switch circuit to connect or disconnect the first adjacent ends of the loop parts together, the loop parts being coupled to at least one of the mutually coupled loops.

12. A loop antenna as defined in claim 11, in which the switch circuit is comprised of a PIN diode, and in which the circuit for controlling the switch circuit is comprised of a circuit for applying a switch control voltage across the PIN diode.

13. A loop antenna comprising a loop connected in series with a capacitor to form a resonant tank, and a further loop formed of two loop parts, first adjacent ends of the loop parts being connected together via a switch circuit, other adjacent ends the loop parts being connected together via a capacitor, and a circuit for controlling the switch circuit to connect or disconnect the first adjacent ends of the loop parts together, the loop parts being coupled to at least one of the mutually coupled loops.

14. A loop antenna as defined in claim 13, in which the switch circuit being comprised of a PIN diode, and the circuit for controlling the switch circuit is comprised of a circuit for applying a control voltage across the PIN diode.

* * * * *